US005272990A

United States Patent [19]

Carter

[11] Patent Number: 5,272,990

[45] Date of Patent: Dec. 28, 1993

[54] PAPERBOARD CORE PALLET

[75] Inventor: Leewood C. Carter, Riceville, Tenn.

[73] Assignee: Reusable Rolls, Inc., Riceville, Tenn.

[21] Appl. No.: 922,564

[22] Filed: Jul. 30, 1992

[51] Int. Cl.[5] ..... B65D 19/2

[52] U.S. Cl. ..... 108/51.3; 108/56.3

[58] Field of Search ..... 108/51.3, 51.1, 56.3, 108/56.1

[56] References Cited

U.S. PATENT DOCUMENTS

| | | | |
|---|---|---|---|
| 3,256,836 | 6/1966 | Peterson et al. | 108/56.1 |
| 3,654,877 | 4/1972 | Barrett | 108/56.1 |
| 3,683,822 | 8/1972 | Roberts et al. | 108/51.3 |
| 5,001,991 | 3/1991 | Smith | 108/51.3 |
| 5,067,418 | 11/1991 | Carter | 108/56.3 |
| 5,119,740 | 6/1992 | Carter | 108/56.3 |

*Primary Examiner*—Jose V. Chen

*Attorney, Agent, or Firm*—Alan Ruderman

[57] ABSTRACT

A pallet constructed from thick walled hollow paperboard cylindrical cores has longitudinally extending runners to which deck forming members are connected, the runners having notches within which the deck forming members are tightly received. Each deck forming member is a longitudinal segment of a thick walled hollow paperboard cylindrical core. The pallet has feet attached to the runners to raise the runners and thus the deck members above the floor so that the pallet has four-way entry for forklifts and also permits use of standard pallet jacks for lifting the pallet. In one embodiment, each foot is a short length of hollow thick walled paperboard core connected to the bottom of the respective runners by a tab and slot connection, the tabs being longitudinal extensions of the feet while the slots being formed in the peripheral surface of the runners transverse to the longitudinal axis. In a second embodiment each foot is a short length of hollow thick walled paperboard core which slidably is connected to a respective end of a runner by cooperating slots.

8 Claims, 3 Drawing Sheets

PAPERBOARD CORE PALLET

BACKGROUND OF THE INVENTION

This invention relates to pallets constructed from paperboard cores or tubes, and more particularly to a pallet having runners formed from thick walled hollow paperboard cylindrical cores and deck members formed as segments of thick walled hollow paperboard cylindrical cores including support feet for providing space for four-way entry and for a pallet jack.

As pointed out in U.S. Pat. No. 5,067,418 large amounts of thick walled paperboard or fiber cores or tubes are used by various industries which thereafter must be disposed of, and that paper, paperboard, carpet, cloth and plastics are wound about such cores which have to be disposed of after removal of the products from the cores. Cores of this type can vary in length, and generally have a four inch, five inch or six inch outside diameter with a wall thickness of at least 0.3 inch with a range of up to 0.750 inch. An ecological solution to the disposal of spent cores was provided for in the aforesaid U.S. Patent by recycling the cores into pallets having spaced apart longitudinally elongated runners formed from such cores and transversely extending elongated deck members formed as segments of such cores, the deck members being received within notches in the top surfaces of the runners.

Although these pallets have found commercial success, the success is somewhat limited by the disposition of the runners on the floor. Since pallets become turned in various directions during shipment, and since most pallets are lifted and moved about by forklift vehicles, it is highly desirable that there be four-way entry beneath the pallet, i.e., the forklift tines should be able to enter beneath the pallet from any of four directions. However, unless large tine accommodating rectangular notches are cut out of the bottom of all of the runners as suggested in the aforesaid patent, which is costly and therefore has not been adopted, the paperboard core pallets only permit two-way entry, i.e., entry from between the runners and not across the runners.

Additionally, almost all of the pallets use runners which have an outside diameter of four inches. Also since the deck members must extend into the top portion of the runners, the bottom of the deck members are disposed approximately 3⅛ inches above the ground. A substantial number of warehouses and the like use pallet jacks for lifting and moving pallets about. A pallet jack has a pair of spaced apart tines, each with a pair of wheels, and a handle including a jacking mechanism. In use, the tines are disposed beneath the pallet and then lifted. However, the known pallet jacks require a 4¼ inch clearance, i.e., the bottom of the pallet deck cannot be below 4¼ inches above the floor. Thus, the conventional pallet jacks cannot be used with pallets of this type having runners formed from cores of a 4 inch outside diameter. The present invention is directed toward a solution of these problems and thus provides an even greater commercialization of the thick wall hollow paperboard core pallets.

SUMMARY OF THE INVENTION

Consequently, it is a primary object of the present invention to provide an economical means for raising the runners of pallets constructed from thick walled hollow paperboard cores above the floor to permit four-way entry and to permit the use of pallet jacks.

It is another object of the present invention to provide a pallet having runners constructed from thick walled hollow paperboard cores interconnected together by deck members constructed from segments of thick walled hollow paperboard cores, and having feet interconnected to the runners for raising the runners above a floor, the feet being constructed from thick walled hollow paperboard cores.

It is a further object of the present invention to provide lifting feet for a pallet having runners constructed from thick walled hollow paperboard cores interconnected together by deck members constructed from segments of thick walled hollow paperboard cores, the feet and the runners having cooperating interlocking elements for connecting the feet into bottom portions of the runners to raise the runners above the floor.

Accordingly, the present invention provides a pallet constructed from paperboard cores. The terminology paperboard cores or tubes and fiber cores used herein appear merely to be distinguishing terms in the various arts. For example, the paper manufacturing industry apparently uses the terminology fiber core, while the carpet industry merely appears to designate these as paperboard tubes. In either case, for consistency, the terminology paperboard cores will be utilized hereinafter, it being understood that although other material may be included, the cores are substantially paperboard.

The pallets have runners or longitudinally extending members formed form such paperboard cores and are connected to deck or platform members. The runners are formed from such cores by cutting out notches for receiving longitudinal segments of other cores for forming upper deck members defining the support platform. The notches are configured so that the core segments defining the support platform may be assembled and tightly secured together by friction without the need for adhesives, and thus may be transported in unassembled form and assembled when needed. Preferably, these notches have a dove tail type configuration and the upper surfaces of the segmented cylindrical cores are substantially coplanar with the upper surfaces of the runners.

In order to raise the runners, and thus the deck members, above the floor so that the pallet has four-way entry and also so that the deck members are raised to a height providing clearance for standard pallet jacks, feet in the form of short lengths of hollow thick walled paperboard cores are connected to bottom portions of the runners. The connection of the feet to the runners also is by means of a friction connection without adhesives and the like.

In a preferred embodiment the runners and the feet have slot and tab elements respectively, so that the feet may frictionally lock into the bottom of the runners with the tabs tightly received within the slots, the feet intermediate the tabs being contoured so as to mate with the surface of the runners. In use, the feet rest on the floor and with at least one foot adjacent each end of each runner. The pallet is thus raised and supported above the floor permitting four-way entry and the use of a pallet jack.

In another preferred embodiment the runners and feet each have longitudinally extending slots disposed at circumferentially spaced locations extending from ends thereof, the slots in a foot being circumferentially aligned with those in the end of a runner so that a foot may slide onto the runner at each end with the axis of the feet parallel to that of the runner. By cutting a portion of the feet along a cord, a flat support face may be provided at the bottom of the feet and the height of the bottom surface of the deck members may be disposed at the desired clearance above the floor.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENTS

Figure 1:
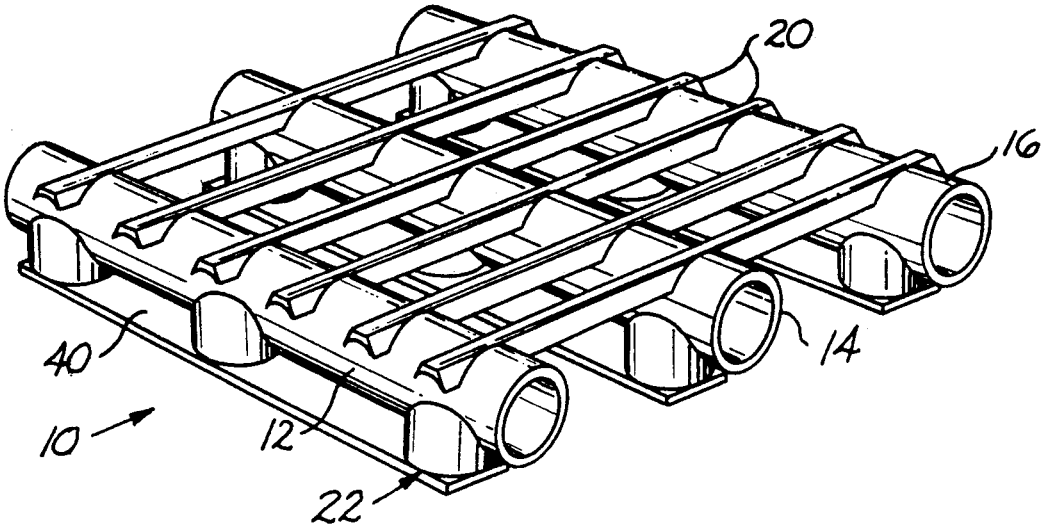
FIG. 1 is a perspective view of a pallet having a preferred embodiment of supporting feet constructed in accordance with the principles of the present invention.

Referring now to the drawings, a pallet generally designated at 10 is illustrated which incorporates structure constructed in accordance with a first embodiment of the present invention. The pallet comprises a plurality of longitudinally elongated runners 12, 14, 16, constructed from hollow thick walled paperboard cores. Cores of this type are readily available as hollow cylindrical members varying in lengths and generally have a four inch, five inch or six inch outside diameter. The most readily available cores are of the four inch diameter size and most pallets utilize runners of this size, although other sizes may be utilized. Cores of this type are typically used as a disposable mandrel about which paper, lingerboard, carpet or the like are wound in a roll and remain with the primary product until the roll is exhausted. These paperboard cores have a wall thickness varying from approximately 0.3 inch to approximately 0.750 inch and are known as thick walled cores. Since they do not readily break down in a pulper and are therefore not desirable for recycling at paperboard mills, they are utilized for the manufacture of paperboard pallets in accordance with the aforesaid U.S. Pat. No. 5,067,418.

Figure 3:
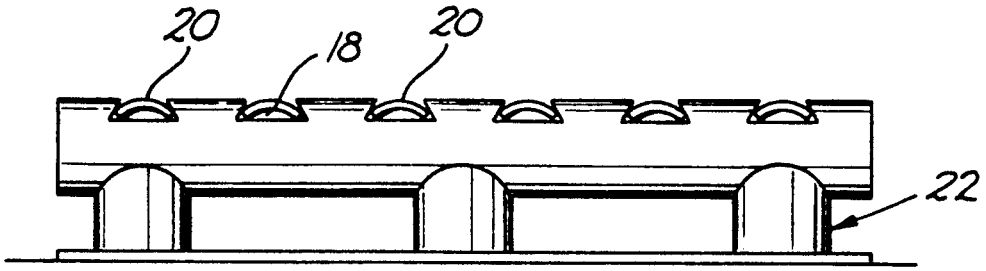
FIG. 3 is a side elevational view of the pallet.
Figure 4:
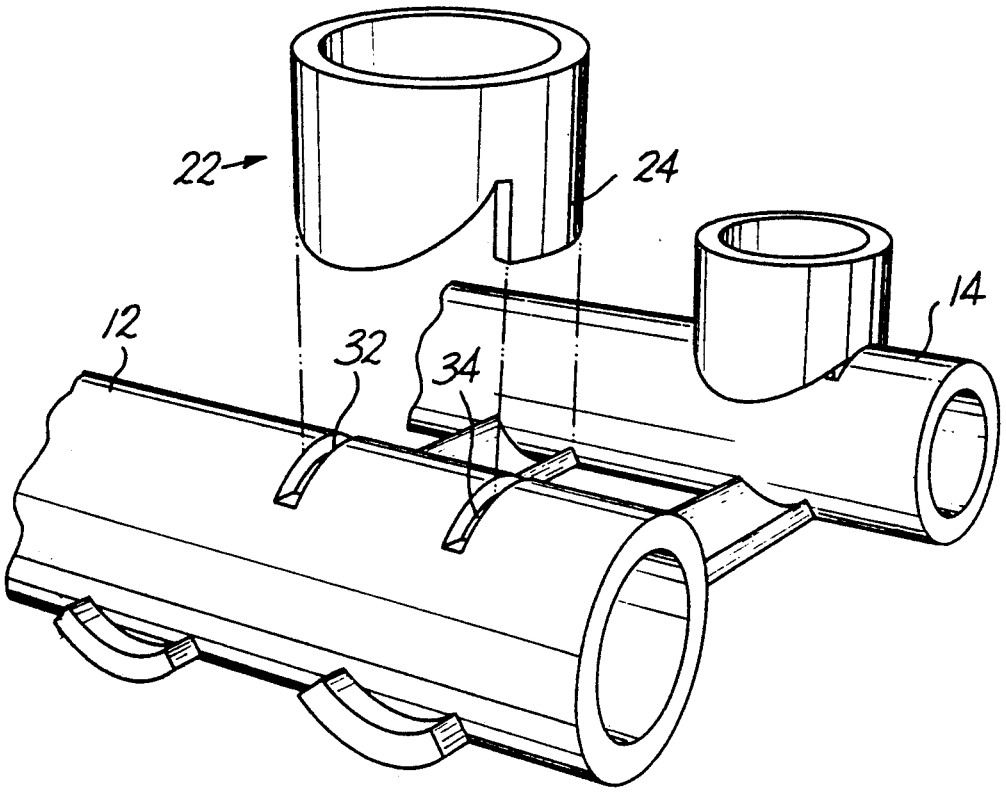
FIG. 4 is an inverted perspective view of a portion of the pallet depicting a foot exploded from a runner to illustrate the connection therebetween.
Figure 5:
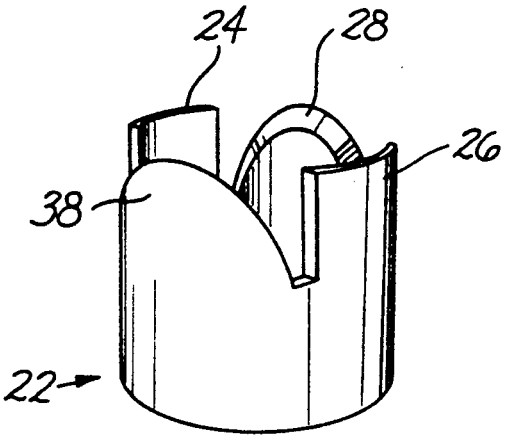
FIG. 5 is a perspective view of a foot.
Figure 6:
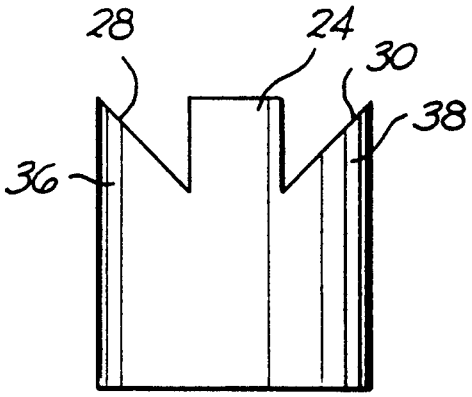
FIG. 6 is an elevational view of the foot illustrated in FIG. 5.

As best illustrated in FIG. 3, the runners include a plurality of notches 18 at longitudinally spaced locations extending transversely relative to the axis of elongation of the runners. The notches preferably are open ended in that they open at the upper periphery of the runners. Disposed within each notch 18 is a cross member 20 formed from longitudinally sectioned segments of other cores as described in the aforesaid patent, the members 20 forming the deck of the pallet and being designated as deck members. The size, shape and depth of the notches 18 permit the upper surface of the deck members to be substantially flush or planar with the upper surfaces of the runners to provide a flat deck surface, the convex surface of the deck members having a central portion substantially in the same plane as the top peripheral surfaces of the runners. The notches 18 of the various runners 12, 14 and 16 are disposed at substantially the same location along the lengths of the respective runners so that the notches may be aligned to receive the deck members 20 as illustrated. Although any number of runners and deck members may be utilized, it is expected that three such runners will typically be utilized with a sufficient number of deck members to support the varying loads to be carried on the pallet. Typically, it is expected that three five foot long runners will be utilized with six or seven deck members.

Preferably, the notches 18 have a dovetail configuration, the wider portion of the notches being radially further into the body of the runner and narrowing toward the periphery. This arrangement permits the deck members to be fitted and slidably positioned within the respective notches during assembly and held therein by friction without being released in the radial direction. Thus, adhesives, mechanical fasteners or the like or not required and the user of the pallet may readily adjust the size of the pallet either by adjusting the runners closer together and trimming the deck members to form a smaller pallet, or by trimming the core lengths. Larger pallets, of course, may be created by using longer length deck members with the runners spaced further apart or with the use of one or more additional runners. As illustrated in FIG. 3, each deck member has its concave surface disposed entirely within the respective notches and the convex surface disposed in the notches with the central portion in substantially the same plane as the top peripheral surfaces of the runners.

The runners 12, 14, 16 are formed by first cutting the starting core material to length and thereafter cutting the notches 18 to the desired configuration including diverging edges extending inwardly from the top by saw blades or other conventional means. The deck members 20, as aforesaid, are formed from segments of other cores. To provide a tight fit the edges of the segments are formed at an angle with the concave surface slightly longer than the convex surface. Since the method for forming the deck members does not form a part of the present invention, further detail is not believed necessary and a fuller disclosure thereof may be had by reference to the aforesaid U.S. Pat. No. 5,067,418.

Figure 2:
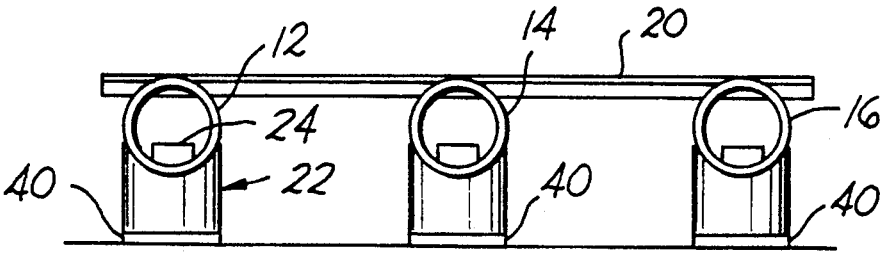
FIG. 2 is an end elevational view of the pallet illustrated in FIG. 1.

Once the deck members 20 are formed they may be positioned within the respective notches 18 merely by sliding them into the notches of the cores in seriatim when desired. As aforesaid, the deck members are positioned with the longer convex surfaces facing the longer edges of the dovetail notches 18, i.e., inwardly relative to the upper peripheral surfaces of the cores 12, 14, 16. By sizing the notches and the deck members properly, the convex surfaces of the deck members 20 may be coplanar with the upper central surface of the runners, as illustrated in FIG. 2, so that the top of the pallet is flat and coplanar for the strongest load supporting deck surface and for support of material without providing a wavy or irregular surface for flexible type loads. If desired a full surface flat deck may be added.

Since substantially all of the runners utilized are of the four inch outside diameter size, the spacing between the upper surface of the runners and thus the deck members is four inches above the floor when the runners are disposed directly on the floor. The bottom edges of the deck members in this case is approximately 3⅛ inches above the floor. Since a conventional pallet jack requires 3½ to 4¼ inches a conventional pallet jack cannot be received beneath the deck of the pallet, nor can the tines of a forklift vehicle be positioned beneath the pallet in the direction transverse to the axis of elongation of the runners with the runners on the floor. Accordingly, the present invention provides lifting feet 22 for raising the runners and thus the pallet above the floor sufficiently for a pallet jack to be positionable at the lower surfaces of the deck members and also to permit a forklift to enter beneath the pallet from a direction transverse to the longitudinal axis of the runners so as to provide four-way entry of such forklift tines beneath the pallet.

The lifting feet 22 are also constructed from hollow thick walled paperboard cores which are cut into desired lengths. Ideally, for pallets of conventional size, there would be three feet for each runner, the central foot precluding sag in the runner under heavy load. Each foot includes a pair of longitudinally extending tabs 24, 26 spaced apart circumferentially by approximately 180° between centers, each tab being a sector extending approximately 60° of the circumference of the core. The space adjacent each edge of the tabs has a portion sliced out at an angle to the longitudinally extending edge of the tabs so as to form a respective inclined surface 28, 30. A pair of partial circumferentially extending slots 32, 34 spaced apart longitudinally are formed in the floor facing surface of the runners. The circumferential length of the slots 32, 34 is substantially equal to or very slightly more than the circumferential length of each tab 24, 26 and the longitudinal spacing between the remote edges of the slots 32, 34 is substantially equal to the outer diameter of the core from which the feet are formed, the width of each slot being substantially equal to or very slightly more than the wall thickness of the core from which the feet are formed. Thus, the tabs 24, 26 may be frictionally received within the respective slots 32, 34. The space between the inclined surfaces 28, 30 and the edge of the adjacent tab provides a clearance into which the circumference of the runner between the slots 32, 34 may be received, the surfaces 28 and 30 abutting the peripheral surface of the respective runner while the portions 36, 38 of the feet defined by the surfaces 28, 30 preferably are shortened relative to that of the tabs to form a continuation of the surface of the runners. Thus, the feet are securely fastened to the runners without fasteners and may be unfastened if desired by prying them loose from the runners.

The feet may be cut to the desired length so that the runners are raised above the floor by the required amount. For example, with a 4 inch diameter core, and with the length of the feet in the order of approximately 3¼ inches from the surface of the feet which engages the floor to the remote end of the tabs, so that the tabs are approximately 1½ inches long, the bottom of the runners are spaced 1¼ inches above the floor and thus the tines of a fork lift may enter into the space between the runners and the floor. Additionally, the bottom of the deck members 20 are then approximately 4½ inches above the floor so that a standard pallet jack may enter between the floor and the bottom of the deck. Thus, the present invention provides the four-way entry for the pallet.

In order to permit the feet 22 to bridge or span the rails of a storage rack or the rollers of a roller conveyor, both of which are used extensively in storage facilities, a flat strip 40 of cardboard, corrugated sheet or the like may be glued to the bottom of the legs of each runner. The strip 40 will thus act as a bridge to span the rack or rollers.

Figure 7:
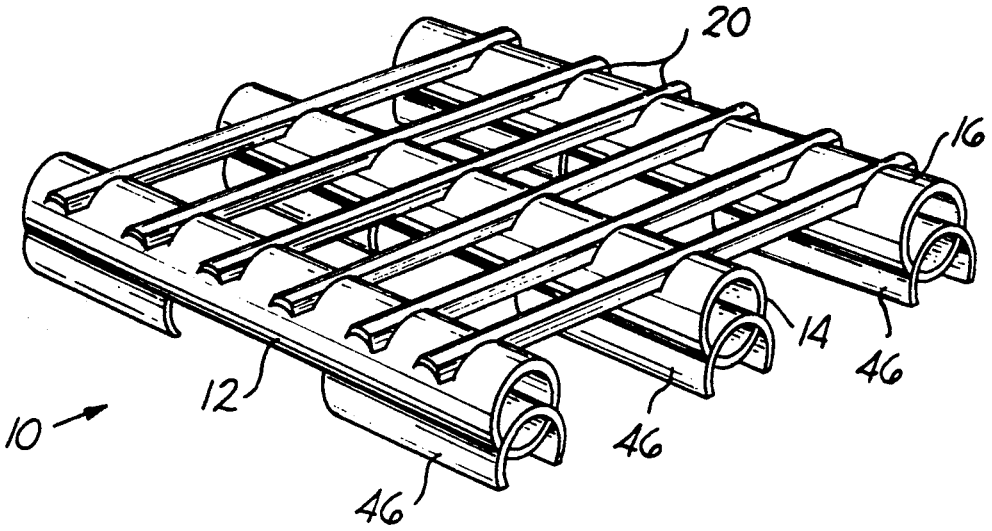
FIG. 7 is a view similar to FIG. 1, but of a second embodiment of supporting feet constructed in accordance with the present invention.
Figure 8:
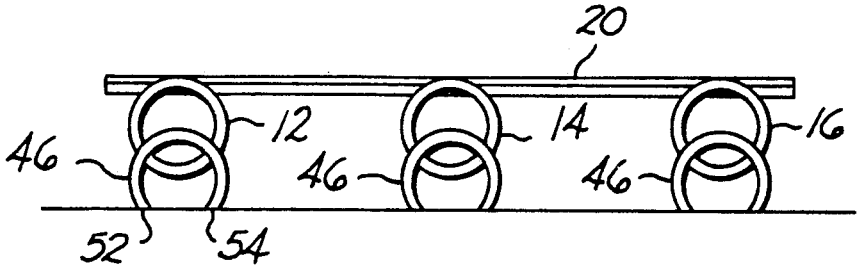
FIG. 8 is an end view of the pallet illustrated in FIG. 7.
Figure 9:
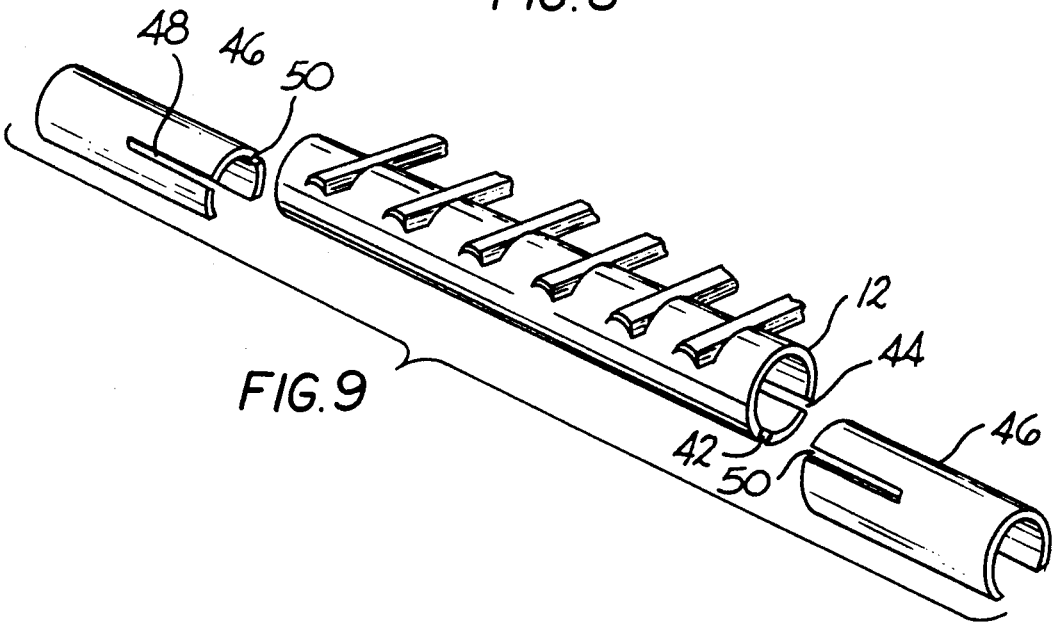
FIG. 9 is a fragmentary perspective view of a portion of the pallet of FIG. 7 with the supporting feet exploded from one of the runners to illustrate the connection therebetween.

Referring to FIGS. 7 through 9, a second embodiment of the invention is illustrated. The pallet 10 including the runners 12, 14, 16 and the deck members 20 are substantially identical to that illustrated in the first embodiment except as hereinafter described. As illustrated in FIG. 9 in respect to the runner 12, at the bottom portion of each end of the runner there are a pair of longitudinally extending slots 42, 44 circumferentially spaced apart. Although the slots 42, 44 are in the bottom half of the runners, the precise disposition is not critical. The thickness of the slots, i.e., circumferentially, are substantially equal to the wall thickness of the runners for reasons which will hereinafter become clear.

A foot 46 formed from a length of hollow thick walled paperboard core substantially identical to that of the runners is formed with a pair of longitudinally extending circumferentially spaced slots 48, 50 a foot, as hereinafter described, is positioned on each end of a runner, the circumferential disposition of the slots 48, 50 being substantially identical to that of the slots 42, 44 so that the slots of the runners are aligned with the slots of the feet. The circumferential thickness of the slots 48, 50 are also equal to the wall thickness of the runners. Additionally, the lengths of the slots 42, 44 and 48, 50 are such that each foot 46 may be slidably disposed on the end of a runner with the exterior ends aligned as illustrated in FIG. 7. This may be readily accomplished by cutting each slot 48 and 50 half the length of the feet 46 and cutting the slots 42 and 44 the same length. The total length of each foot preferably is of a sufficient length so that with a foot on each end of the runners, the feet span or bridge the rails of a storage rack or the rollers of a roller conveyor. With this construction, each foot may slidably be positioned on the end of each runner by aligning the slots 48, 50 at one end with the slots 42, 44 and aligning the slots 50, 48 at the other end with the slots 42, 44 and forcibly sliding the feet onto the runner. Since the circumferential thickness of the slots is substantially equal to the wall thickness of the core from which the runners and feet are formed, the slots of the feet receive inner and outer surface portions of the runners and the slots of the runners receive inner and outer surface portions of the feet in a frictionally tight fit.

The circumferential spacing of the slots 42 and 44 and between the slots 48 and 50, of course, determines the height the bottom surface of the runners are disposed above the floor. By forming the feet from four inch diameter cores such as the cores from which the runners are formed, and with the slots 42, 44 and the bottom portion of the runners and slots 48, 50 in the top portion of the feet, as illustrated in FIG. 8, the runners may be raised more than the required amount to provide four-way entry for the pallet. This amount may be adjusted and simultaneously the feet may have planar floor engaging surfaces 52, 54 by cutting a portion of the feet along the cord, the location at which the cut is made should provide the desired clearance of the deck members above the floor as explained in regard to the first embodiment, e.g., approximately 4½ inches.

Accordingly, there is provided an improvement to the pallet disclosed in U.S. Pat. No. 5,067,418 which permits not only four-way entry but also permits the use of a pallet jack as aforesaid, this increases the flexibility of the pallet for use in varying environments, the feet being used only when desired.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A pallet comprising a load supporting deck and a plurality of spaced apart longitudinally elongated runners, said runners being formed from substantially identical cross section thick walled hollow paperboard cylindrical cores, each core including a plurality of longitudinally spaced apart substantially identically configured notches extending transversely therethrough and opening outwardly onto a longitudinal top peripheral surface of the respective runner, said runners being disposed so that the notches of each runner are aligned vertically and longitudinally with corresponding notches in other runners, said deck including a plurality of transversely extending spaced apart deck members, each of said deck members being a longitudinally extending arcuate segment of a thick walled hollow paperboard cylindrical core, each segment having a pair of longitudinally extending edges, a convex surface and a concave surface, each segment being slidably received and positioned within respective aligned notches of the runners with said longitudinally extending edges in tight frictional engagement with transverse wall portions of said notches, with said concave surface disposed entirely within the respective notches, and with said convex surface disposed in the respective notches and having a central portion in substantially the same plane as the top peripheral surfaces of said runners, a plurality of feet secured to each runner for disposing said runners above a floor surface, each of said feet comprising a length of thick walled hollow paperboard core having a support portion disposed in a plane below the plane of the bottom of the respective runner for resting on said floor surface, and interconnecting means on said runners and said feet for connecting said feet to respective runners.

2. A pallet as recited in claim 1, wherein each of said feet has a longitudinal axis disposed substantially normal to the longitudinal axis of a runner to which it is connected.

3. A pallet as recited in claim 2, including an elongated strip fastened to all of the feet secured to a respective runner.

4. A pallet as recited in claim 2, wherein said interconnecting means each comprises a pair of transverse slots spaced apart longitudinally in the peripheral surface of said runner, and a pair of spaced apart tabs formed on each foot and extending longitudinally from said foot, said tabs being disposed within said slots when said feet are connected to said runners.

5. A pallet as recited in claim 4, wherein said feet have portions intermediate said tabs for abutting the peripheral surface of said runners.

6. A pallet as recited in claim 5, including an elongated strip fastened to all of the feet secured to a respective runner.

7. A pallet as recited in claim 1, wherein each of said feet has a longitudinal axis disposed substantially parallel to the longitudinal axis of a runner to which it is connected.

8. A pallet as recited in claim 7, wherein said interconnecting means comprise a pair of longitudinally extending slots formed in said runners at each end, the circumferential thickness of each slot being equal to the wall thickness of said feet, the slots of each pair being spaced apart circumferentially in a bottom portion of said runners, and a pair of longitudinally extending slots formed in each foot at one end, the circumferential thickness of the slots in each foot being equal to the wall thickness of said runners, the slots of each foot being spaced apart circumferentially in an upper portion of the foot, and the circumferential spacing between the slots in a foot being substantially identical to the circumferential spacing between the slots in said runners, where by said feet are slidably disposed on respective runners with the slots of said feet aligned with the slots of said runner.

* * * * *